US011414289B2

(12) United States Patent
Kimura

(10) Patent No.: US 11,414,289 B2
(45) Date of Patent: Aug. 16, 2022

(54) SHEET HANDLING DEVICE AND IMAGE FORMING APPARATUS INCORPORATING THE SHEET HANDLING DEVICE

(71) Applicant: Ippei Kimura, Kanagawa (JP)

(72) Inventor: Ippei Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 199 days.

(21) Appl. No.: 16/740,674

(22) Filed: Jan. 13, 2020

(65) Prior Publication Data

US 2020/0239261 A1 Jul. 30, 2020

(30) Foreign Application Priority Data

Jan. 24, 2019 (JP) ..... JP2019-010401

(51) Int. Cl.

| | |
|---|---|
| ***B65H 27/00*** | (2006.01) |
| ***B65H 3/06*** | (2006.01) |
| ***B65H 5/06*** | (2006.01) |
| ***B65H 3/56*** | (2006.01) |

(52) U.S. Cl.

CPC ..... *B65H 27/00* (2013.01); *B65H 3/0638* (2013.01); *B65H 3/56* (2013.01); *B65H 5/06* (2013.01); *B65H 2301/42262* (2013.01); *B65H 2301/44324* (2013.01); *B65H 2404/12* (2013.01); *B65H 2801/06* (2013.01)

(58) Field of Classification Search

CPC ..... B65H 27/00; B65H 2404/134; B65H 2404/1375; B65H 3/0638; B65H 2402/63; B65H 2402/64; B65H 2601/324

See application file for complete search history.

(56) References Cited

U.S. PATENT DOCUMENTS

| | | | | |
|---|---|---|---|---|
| 9,884,736 | B2 * | 2/2018 | Yamasaki | B65H 3/0607 |
| 10,023,408 | B2 * | 7/2018 | Kawashima | G03G 15/6511 |
| 10,040,652 | B2 * | 8/2018 | Fujita | B65H 1/266 |
| 2006/0180985 | A1 * | 8/2006 | Lee | B65H 3/0638 271/109 |
| 2008/0101842 | A1 * | 5/2008 | Takahashi | B41J 29/023 400/617 |
| 2012/0104685 | A1 | 5/2012 | Nishii et al. | |
| 2013/0043647 | A1 | 2/2013 | Fujii et al. | |
| 2013/0164066 | A1 | 6/2013 | Nakamura et al. | |
| 2013/0177342 | A1 | 7/2013 | Tada et al. | |
| 2013/0200562 | A1 | 8/2013 | Matsuyama et al. | |
| 2013/0228962 | A1 | 9/2013 | Kimura et al. | |
| 2014/0049000 | A1 | 2/2014 | Kimura et al. | |

(Continued)

FOREIGN PATENT DOCUMENTS

| | | |
|---|---|---|
| JP | 10-077129 | 3/1998 |
| JP | 2003-089442 | 3/2003 |
| JP | 2015-075497 | 4/2015 |

*Primary Examiner* — Howard J Sanders

(74) *Attorney, Agent, or Firm* — Harness, Dickey & Pierce, P.L.C.

(57) ABSTRACT

A sheet handling device includes a shaft, a roller, and a joint. The roller is detachably attached on an end portion of the shaft. The joint is mounted on the end of the shaft and has a claw at a tip of the joint. The claw of the joint is configured to position the roller in a thrust direction along the shaft while an inner circumferential surface of the roller is in contact with an outer circumferential surface of the shaft. The inner circumferential surface of the roller has a cylindrical shape.

16 Claims, 9 Drawing Sheets

(56) References Cited

U.S. PATENT DOCUMENTS

| | | | | |
|---|---|---|---|---|
| 2014/0077444 | A1 | 3/2014 | Fujii et al. | |
| 2014/0103603 | A1 | 4/2014 | Horita et al. | |
| 2014/0319759 | A1 | 10/2014 | Fujii et al. | |
| 2015/0097334 | A1* | 4/2015 | Sekiguchi | B65H 27/00 271/275 |
| 2015/0274450 | A1 | 10/2015 | Fujii et al. | |
| 2015/0274452 | A1 | 10/2015 | Tanaka et al. | |
| 2019/0152729 | A1 | 5/2019 | Kimura | |
| 2020/0041946 | A1* | 2/2020 | Sekigawa | G03G 15/6511 |

* cited by examiner

SHEET HANDLING DEVICE AND IMAGE FORMING APPARATUS INCORPORATING THE SHEET HANDLING DEVICE

CROSS-REFERENCE TO RELATED APPLICATION

This patent application is based on and claims priority pursuant to 35 U.S.C. § 119(a) to Japanese Patent Application No. 2019-010401, filed on Jan. 24, 2019, in the Japan Patent Office, the entire disclosure of which is hereby incorporated by reference herein.

BACKGROUND

Technical Field

This disclosure relates to a sheet handling device and an image forming apparatus incorporating the sheet handling device.

Discussion of the Background Art

Various types of sheet handling devices such as sheet feeding devices, sheet separating devices, and sheet conveying devices are known to be provided in an image forming apparatus.

SUMMARY

At least one aspect of this disclosure provides a sheet handling device including a shaft, a roller, and a joint. The roller is detachably attached on an end portion of the shaft. The joint is mounted on the end of the shaft and has a claw at a tip of the joint. The claw of the joint is configured to position the roller in a thrust direction along the shaft while an inner circumferential surface of the roller is in contact with an outer circumferential surface of the shaft. The inner circumferential surface of the roller has a cylindrical shape.

Further, at least one aspect of this disclosure provides an image forming apparatus including the above-described sheet handling device.

BRIEF DESCRIPTION OF THE SEVERAL VIEWS OF THE DRAWINGS

An exemplary embodiment of this disclosure will be described in detail based on the following figured, wherein.

Figure 1:
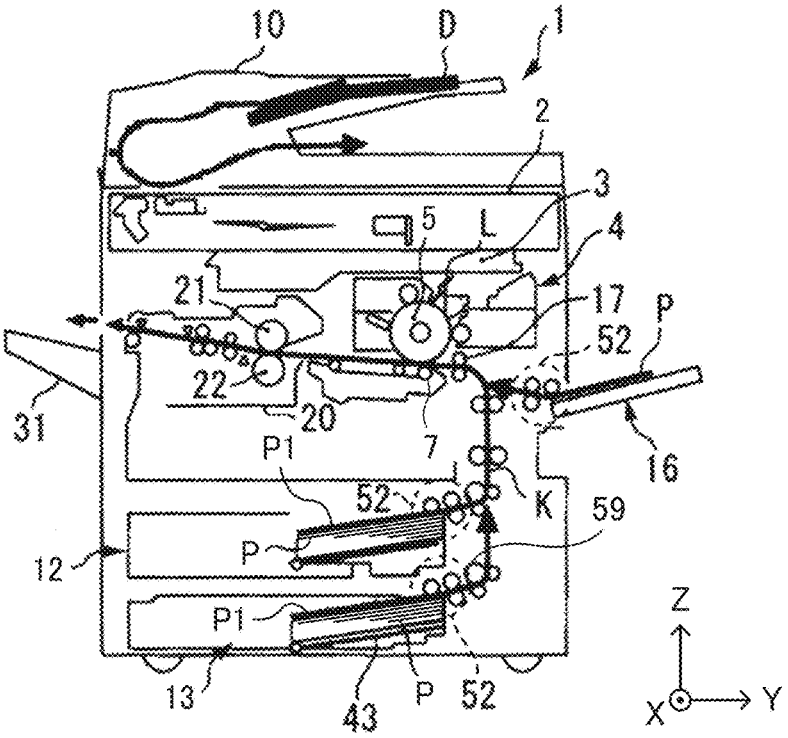
FIG. 1 is a schematic view illustrating a configuration of an image forming apparatus according to an embodiment of this disclosure, including a sheet feeding device according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet handling device, and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet handling device, and image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an electrophotographic image forming apparatus (hereinafter simply referred to as an image forming apparatus) which forms an image by an electrophotographic system is described as an image forming apparatus including a drive transmitter including an electromagnetic unit according to this disclosure. In the following embodiments, a monochrome laser printer is described as an example of the image forming apparatus. However, the image forming apparatus is not limited to a monochrome printer but may be a color printer. The image forming apparatus is not limited to the printer and may be another image forming apparatus such as a copier and a multifunction peripheral. The image forming apparatus including the sheet handling device according to the present embodiment is not limited to the image forming apparatus of the electrophotographic system, and may be an image forming apparatus of another system such as an ink jet system.

FIG. 1 is a schematic view illustrating a configuration of an image forming apparatus 1 according to an embodiment of this disclosure, including sheet feeding devices 12 and 13 according to an embodiment of this disclosure.

It is to be noted that reference sign "X" indicates is a direction from the front side to the rear side of the image forming apparatus 1, reference sign "Y" indicates is a direction from the left side to the right side of the image forming apparatus 1, and reference sign "Z" indicates is a direction perpendicular to the direction X and the direction Y.

An original document D is conveyed (fed) by an original document conveying unit 10 in a direction indicated by arrow in FIG. 1 and passes over a document reading device 2, so that the document reading device 2 optically reads image data of the original document D. An exposure light L such as optical laser light based on the read image data is emitted from an exposure device 3 (in other words, an optical writing device) to irradiate a photoconductor drum 5 of an image forming device 4. After predetermined image forming processes (e.g., a charging process, an exposing process, and a developing process), the image forming device 4 forms an image (i.e., a toner image) corresponding to the image data is formed on the photoconductor drum 5. A sheet P is conveyed from a selected one of the sheet feeding devices 12 and 13 to a pair of registration rollers 17 and the image formed on the photoconductor drum 5 is transferred by a transfer device 7 onto the sheet P. Similarly, a sheet P loaded on a bypass tray 16 is conveyed so that the image formed on the photoconductor drum 5 is transferred by the transfer device 7 onto the sheet P. After the transfer process, a fixing device 20 includes a fixing roller 21 and a pressure roller 22 to fix an unfixed toner image formed on the sheet P to the sheet P by application of heat by the fixing roller 21 and pressure by the pressure roller 22. Then, the sheet P is conveyed and stacked on a sheet ejection tray 31.

As described above, the image forming apparatus 1 includes a plurality of sheet feeding devices, which are the sheet feeding devices 12 and 13. The sheet feeding devices 12 and 13 have identical structures to each other. The sheet feeding device 13 includes a sheet loader 43 (that is, an elevation plate) and a sheet feeding mechanism 52. The sheet feeding mechanism 52 that functions as a sheet feeder to feed a sheet P loaded on the sheet loader 43.

Figure 2:
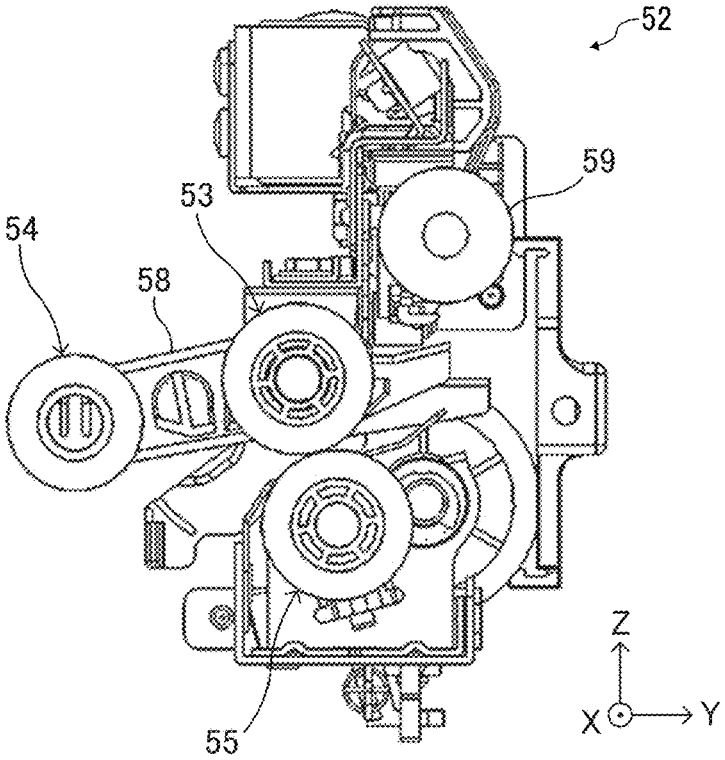
FIG. 2 is an enlarged view illustrating the sheet feeding device of FIG. 1.

FIG. 2 is an enlarged view illustrating the sheet feeding device 13 of FIG. 1.

The sheet feeding mechanism 52 is a feed and reverse roller (FRR) sheet feeding system including a sheet feed roller 53, a pickup roller 54, and a sheet separation roller 55. The pickup roller 54 is detachably attachable to a sheet P (i.e., an uppermost sheet P1) loaded on the sheet loader 43, by an arm 58 or a solenoid. When a plurality of sheets P is gripped in a nip region between the sheet separation roller 55 and the sheet feed roller 53, the sheet separation roller 55 functions as a sheet separation body that separates the uppermost sheet P1 from subsequent sheets P of the plurality of sheets P so that the uppermost sheet P1 alone is fed in a sheet conveyance direction along with rotation of the sheet feed roller 53. The image forming apparatus 1 further includes a sheet conveying roller 59 that conveys the sheet P fed from the sheet feeding mechanism 52. The sheet P conveyed by the sheet conveying roller 59 passes through a sheet conveyance passage K to be conveyed to the pair of registration rollers 17.

Figure 3A:
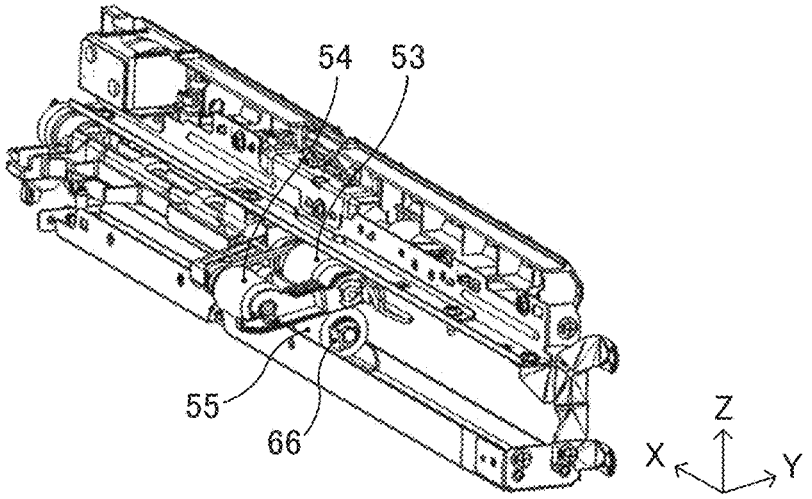
FIGS. 3A, 3B, and 3C are diagrams illustrating a sheet feeding mechanism of the sheet feeding device of FIG. 1.
Figure 3B:
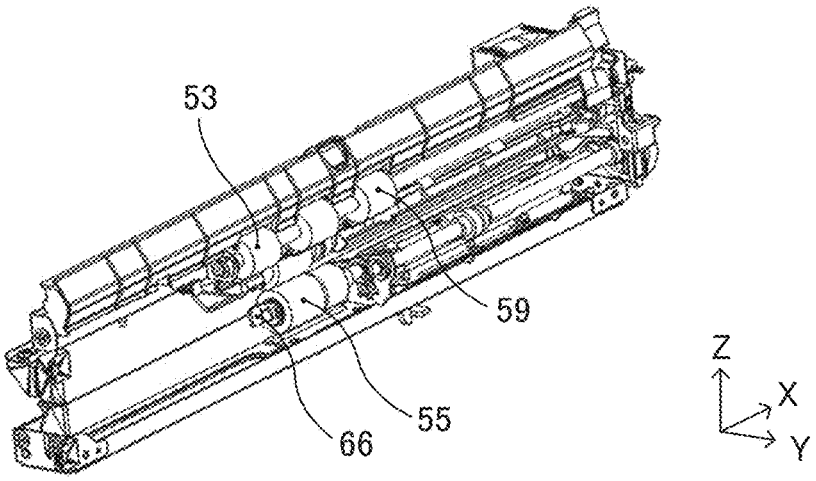
Figure 3C:
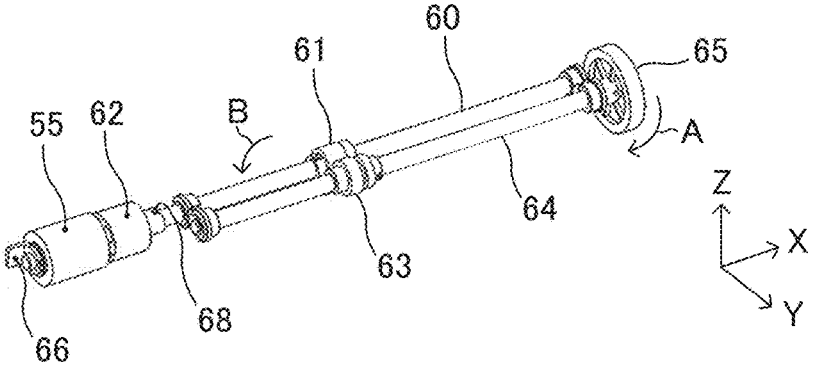

FIGS. 3A, 3B, and 3C are diagrams illustrating the sheet feeding mechanism 52 of the sheet feeding device (i.e., the sheet feeding devices 12 and 13) of FIG. 1. To be more specific, FIG. 3A is a perspective view of the sheet feeding mechanism 52 viewed from the sheet loader 43, FIG. 3B is a perspective view of the sheet feeding mechanism 52 viewed from an opposite side of FIG. 3A, and FIG. 3C is an enlarged view of a drive transmitting portion of the sheet separation roller 55 in FIG. 3B.

As illustrated in FIG. 3C, the sheet separation roller 55 is mounted on a roller attaching shaft 60. The roller attaching shaft 60 includes a gear 61 and a torque limiter 62. A gear 63 to be meshed with the gear 61 is provided on a drive transmission shaft 64 that extends in parallel with the roller attaching shaft 60. A large diameter gear 65 is mounted on the drive transmission shaft 64 at a far end (i.e., the rear end) of the image forming apparatus 1. As the large diameter gear 65 rotates in a direction indicated by A in FIG. 3C, a driving force is transmitted from a motor to the large diameter gear 65. By so doing, the driving force is transmitted to the roller attaching shaft 60 on which the sheet separation roller 55 is mounted, via the gear 63 and the gear 61 (in other words, the roller attaching shaft 60 rotates in a direction indicated by B in FIG. 3C. A different large diameter gear is mounted on another roller attaching shaft where the sheet feed roller 53 that is meshed with the large diameter gear 65 is mounted. The driving force is transmitted to the sheet feed roller 53 via this large diameter gear. The driving force is transmitted to the pickup roller 54 in the order from a small diameter gear mounted on the roller attaching shaft of the sheet feed roller 53, an idler gear, and a gear mounted on the roller attaching shaft of the pickup roller 54.

The torque limiter 62 mounted on the roller attaching shaft 60 on which the sheet separation roller 55 is mounted transmits the driving force from the motor to the sheet separation roller 55 or blocks the driving force from the motor to the sheet separation roller 55. When a single sheet P is gripped in the nip region between the sheet feed roller 53 and the sheet separation roller 55 or when no sheet P is gripped between the sheet feed roller 53 and the sheet separation roller 55, a rotational load applied to the sheet separation roller 55 is relatively large, and the drive transmission from the motor to the sheet separation roller 55 is blocked. At this time, the sheet separation roller 55 idles relative to the torque limiter 56 and is rotated together with the sheet feed roller 53. When a plurality of sheets P is gripped in the nip region, the driving force is transmitted from the motor to the sheet separation roller 55 with a relatively small rotational load applied to the sheet separation roller 55 is due to slippage between the sheets P. Consequently, out of the plurality of sheets P nipped in the nip region, the lower sheets (in other words, the subsequent sheets) of the plurality of sheets P other than the uppermost sheet P1 are returned to the sheet loader 43.

As illustrated in FIGS. 3A and 3B, the sheet feed roller 53, the pickup roller 54, and the sheet separation roller 55 are held while being inserted into respective free end sides of the shafts supported to a housing frame of the image forming apparatus 1 in a cantilever manner. Each of the sheet feed roller 53, the pickup roller 54, and the sheet separation roller 55 has a roller portion including a rubber material (or a resin material) on a shaft portion, and the roller portion is detachable (replaceable) from the roller attaching shaft. Since each of the sheet feed roller 53, the pickup roller 54, and the sheet separation roller 55 has a life shorter than the life of the image forming apparatus 1 and may be replaced in the market, the above-described configuration enhances the replaceability and maintainability. As illustrated in FIG. 3C, a snap ring 66 is attached to the roller attaching shaft 60 so as to regulate a position of the sheet separation roller 55 in a thrust direction of the sheet separation roller 55 along the roller attaching shaft 60 so as to prevent the sheet separation roller 55 from coming out from the free end side of the roller attaching shaft 60. This method using a snap ring such as the snap ring 66 corresponds to a comparative configuration. By contrast, a method using a thrust regulation structure according to an embodiment of this disclosure will be described in detail below.

For example, a comparative sheet feeding device includes a roller that is detachably attached to an end portion of a roller attaching shaft. The end portion of the roller attaching shaft includes a joint member having an outer circumferential surface of a conical shape, and a claw is provided at a tip of the conical outer circumferential surface of the joint member. The roller has an inner circumferential surface having a shape corresponding to the shape of the outer circumferential surface of the joint member. In a state in which the outer circumferential surface of the joint member is in contact with the inner circumferential surface of the roller, the roller in the thrust direction of the sheet separation roller along the roller attaching shaft is positioned by the claw.

Figure 4A:
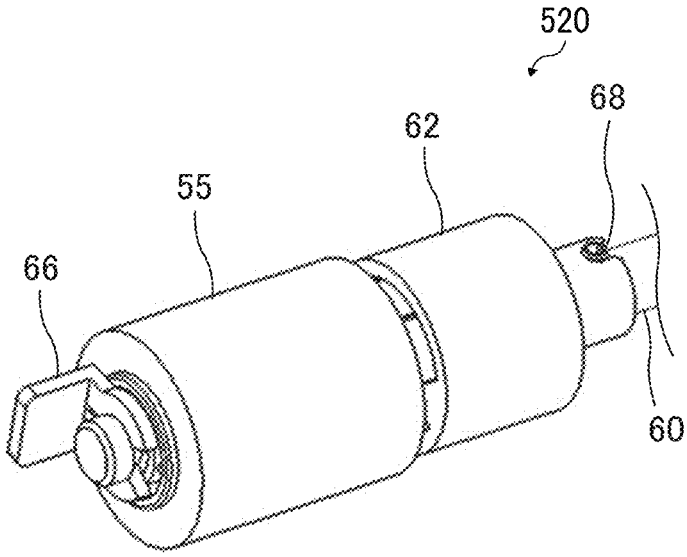
FIGS. 4A and 4B are diagrams illustrating a sheet feeding mechanism of a comparative sheet feeding device.
Figure 4B:
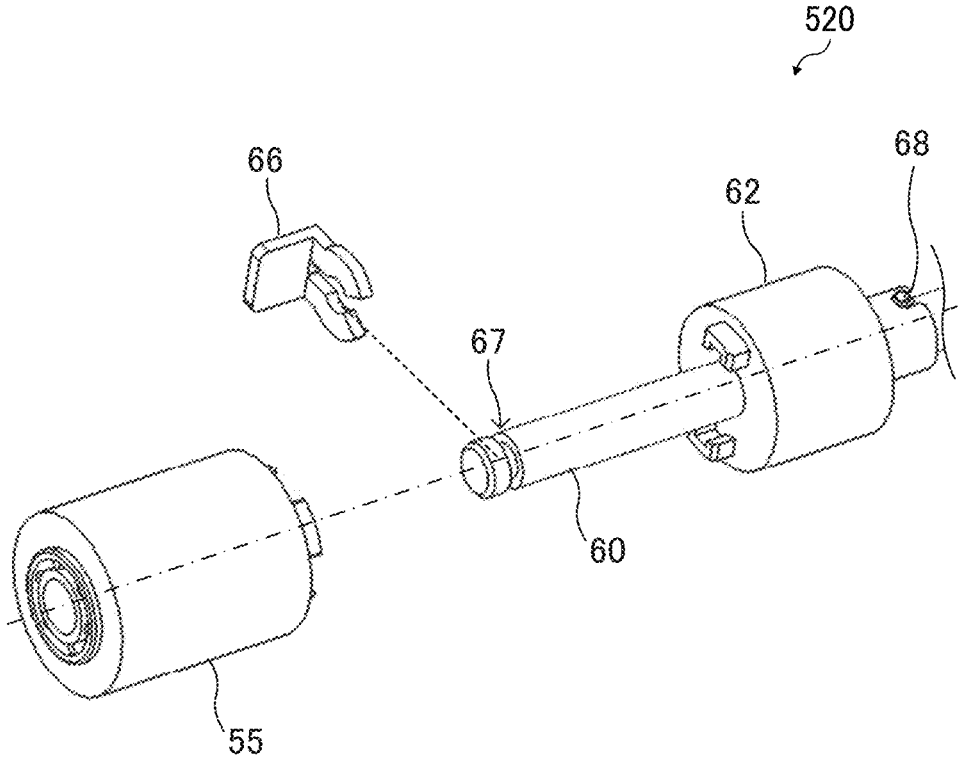

FIGS. 4A and 4B are diagrams illustrating a comparative sheet feeding mechanism 520 of a comparative sheet feeding device. To be more specific, FIG. 4A is an enlarged view of an area near the sheet separation roller 55 of the comparative sheet feeding mechanism 520 of FIG. 3C, and FIG. 4B is an exploded perspective view of the comparative sheet feeding mechanism 520 where the sheet separation roller 55 is removed.

The sheet separation roller 55 is inserted into an end portion of the roller attaching shaft 60 made of metal, and the snap ring 66 is clamped in a groove 67 provided in the roller attaching shaft 60. The snap ring 66 regulates an outer position of the sheet separation roller 55 in the thrust direction of the sheet separation roller 55 along the roller attaching shaft 60. A spring pin 68 is mounted on the roller attaching shaft 60, and the torque limiter 62 is engaged with the spring pin 68. A thrust regulation on the opposite side is executed by the torque limiter 62 engaged with the spring pin 68. In other words, the sheet separation roller 55 in the thrust direction on the opposite side of the roller attaching shaft 60 is regulated by the torque limiter 62 engaged with the spring pin 68.

Different from the comparative sheet feeding mechanism of the above-described comparative example, the comparative sheet feeding mechanism 520 including the snap ring 66 generates the following problems. Attaching or detaching the snap ring 66 to or from the groove 67 provided at the roller attaching shaft 60 made of metal is often performed in an environment having poor operability. A portion where each roller is mounted is likely to be located on a lower side in a machine layout and is hardly accessible. Such working space is relatively narrow and dark. Due to such poor operability, the snap ring 66 cannot be smoothly attached or detached to or from the groove 67. In addition, there may be a case in which the snap ring 66 is slipped and dropped from the hand or hands of a user to be lost inside the machine, and therefore the user additionally needs to look for the snap ring when lost.

It is to be noted that that the comparative sheet feeding mechanism of the comparative example has a problem in which sheet handling becomes unstable due to occurrence of a failure such as a paper jam over time as described above, which is caused by the following reasons. Since a joint member that is provided at the end portion of the roller attaching shaft is in contact with an inner circumferential surface of the roller to directly hold the roller, it is difficult to obtain the accuracy of a center position of the roller with respect to the roller attaching shaft. Due to such fluctuation of the center position of the roller, a rubber portion of the roller is unevenly worn away over time, and an outer diameter of the roller is changed. As a result, a paper jam is easily caused by the wear. In the above-described comparative sheet feeding mechanisms, since the outer circumferential surface of the roller directly receives the inner circumferential surface of the roller, the accuracy of the center position of the roller is easily obtained.

In the thrust regulation structure according to an embodiment of this disclosure, the thrust regulation of detachment and attachment of the roller is performed in a configuration in which degradation of workability is not caused when compared with the configuration employing the snap ring and the position accuracy of the roller with respect to the roller attaching shaft is easily obtained.

Embodiment 1

A description is given of a thrust regulation structure according to Embodiment 1 of this disclosure.

Figure 5A:
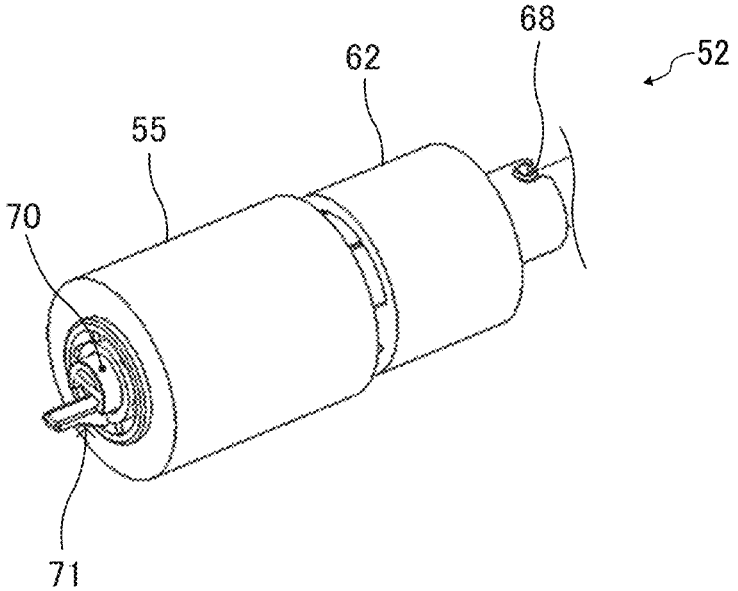
FIGS. 5A and 5B are diagrams illustrating a thrust regulation structure according to Embodiment 1.
Figure 5B:
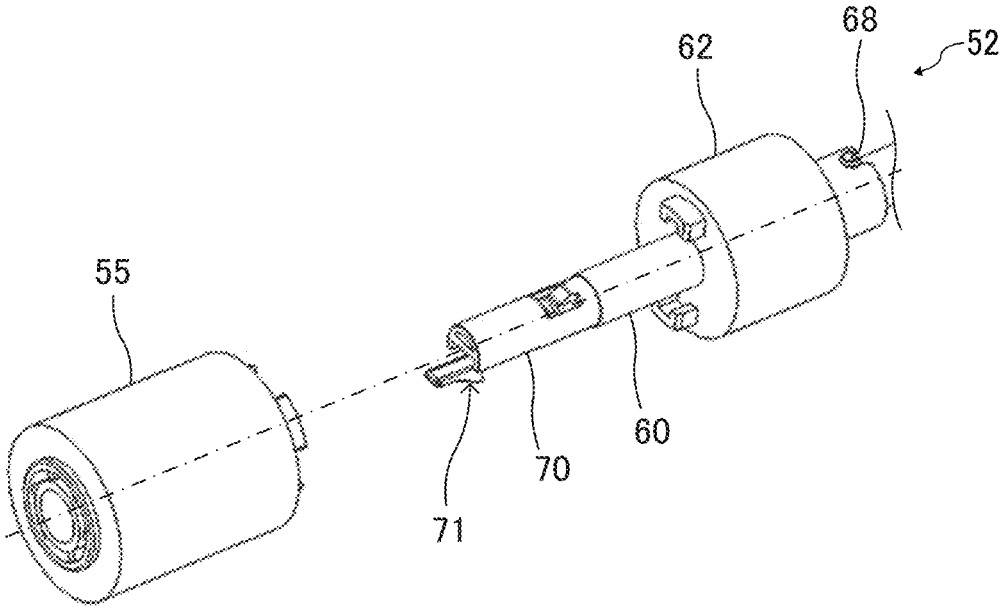

FIGS. 5A and 5B are diagrams illustrating a thrust regulation structure of a sheet feeding mechanism 52 according to Embodiment 1, where the thrust regulation structure of the sheet feeding mechanism 52 is applied to the sheet separation roller 55 to prevent the sheet separation roller 55 from slipping from a free end of a shaft portion. To be more specific, FIG. 5A is an enlarged perspective view illustrating the thrust regulation structure of the sheet feeding mechanism 52 with the sheet separation roller 55 and parts disposed near the sheet separation roller 55, and FIG. 5B is an exploded perspective view of the thrust regulation structure of the sheet feeding mechanism 52 with the sheet separation roller 55 being removed.

A joint member 70 that functions as a joint includes a resin material. The joint member 70 made of resin is fitted to the roller attaching shaft made of metal, and the sheet separation roller 55 is attached to an outer circumference of the joint member 70 by insertion. A regulation claw 71 is provided at a tip of the joint member 70. The regulation claw 71 is engaged with an end face on the free end side of the sheet separation roller 55 to regulate the outer position of the sheet separation roller 55 in the thrust direction of the sheet separation roller 55 along the roller attaching shaft 60.

Figure 6A:
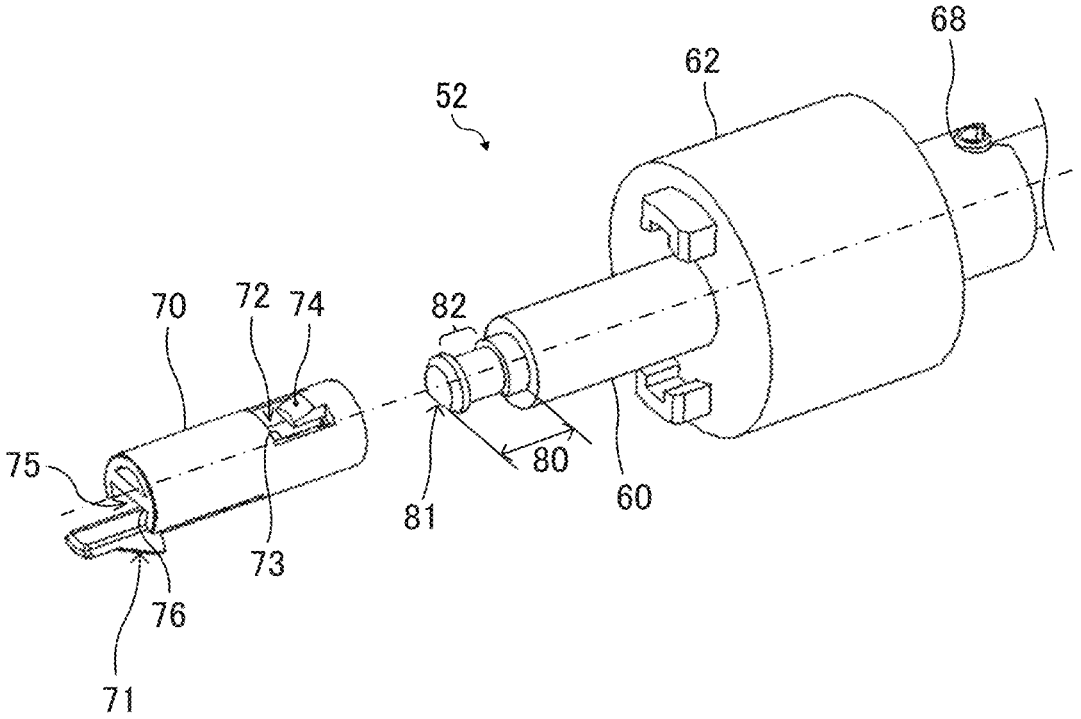
FIGS. 6A and 6B are diagrams illustrating a configuration of a joint portion of a joint member and an attaching shaft in the thrust regulation structure of FIGS. 5A and 5B.
Figure 6B:
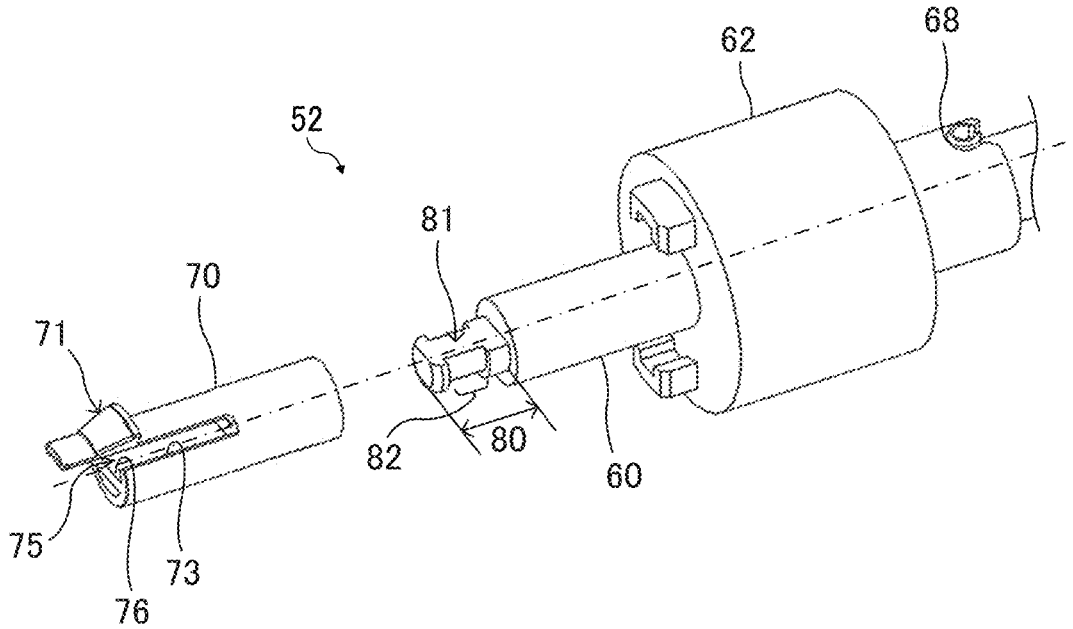

FIGS. 6A and 6B are diagrams illustrating a configuration of a joint portion of the joint member 70 and the roller attaching shaft 60 in the thrust regulation structure of the sheet feeding mechanism 52 of FIGS. 5A and 5B. Specifically, FIG. 6A is an exploded perspective view of the thrust regulation structure of the sheet feeding mechanism 52 in a state in which the joint member 70 is removed, and FIG. 6B is a perspective view of the thrust regulation structure of the sheet feeding mechanism 52 in a state in which the joint portion is rotated from the state of the sheet feeding mechanism 52 in FIG. 9A by 180 degrees around a center line of the joint member 70 and the roller attaching shaft 60.

The roller attaching shaft 60 includes a small-diameter joint portion 80 at a tip of the roller attaching shaft 60. The small-diameter joint portion 80 includes a D-cut portion 81 having a flat shape over an entire width in the axial direction. A groove 82 is provided on an outer circumferential surface of the small-diameter joint portion 80 excluding the D-cut portion 81. The groove 82 extends in a circumferential direction of the small-diameter joint portion 80.

A rear end side of the joint member 70 is open, where an insertion opening 72 is provided. The insertion opening 72 has an inner circumferential surface that correspond to the small-diameter joint portion 80 of the roller attaching shaft 60. The insertion opening 72 has a cut portion 73 and a joint claw 74. The cut portion 73 is made by partly cutting away a circumferential wall portion of the insertion opening 72. The joint claw 74 is provided on the circumferential wall other than the cut portion 73. Additionally, a hollow portion 75 is provided at the tip of the joint member 70. A tip of the hollow portion 75 is open. The hollow portion 75 has a cut portion 76 and the regulation claw 71. The cut portion 76 is made by partly cutting away a circumferential wall portion of the hollow portion 75. The regulation claw 71 is provided on the circumferential wall other than the cut portion 76 on the outer circumference of the tip of the hollow portion 75.

Figure 7A:
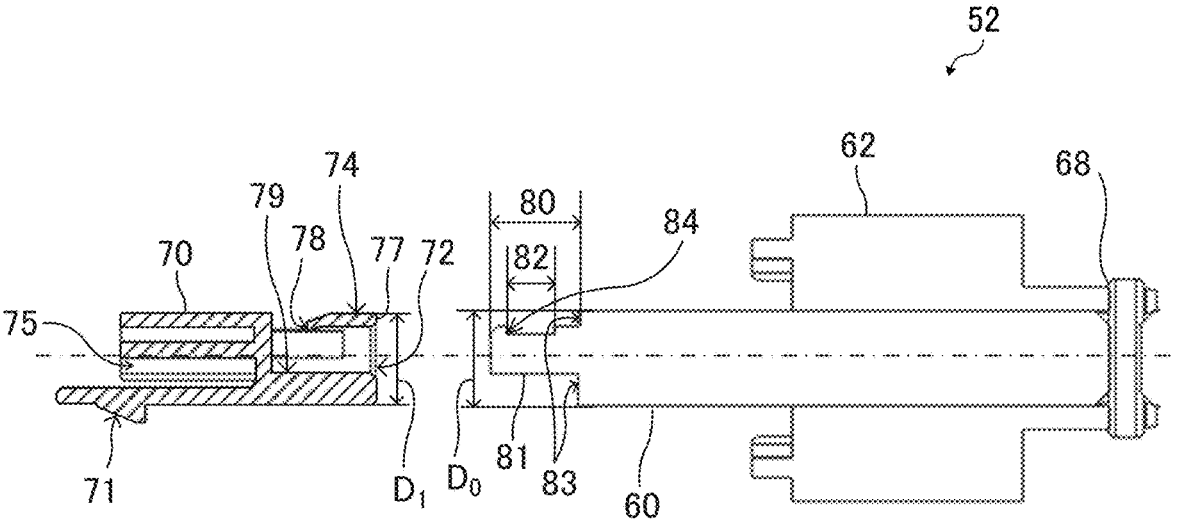
FIGS. 7A and 7B are longitudinal cross-sectional views illustrating the thrust regulation structure of FIGS. 5A and 5B.
Figure 7B:
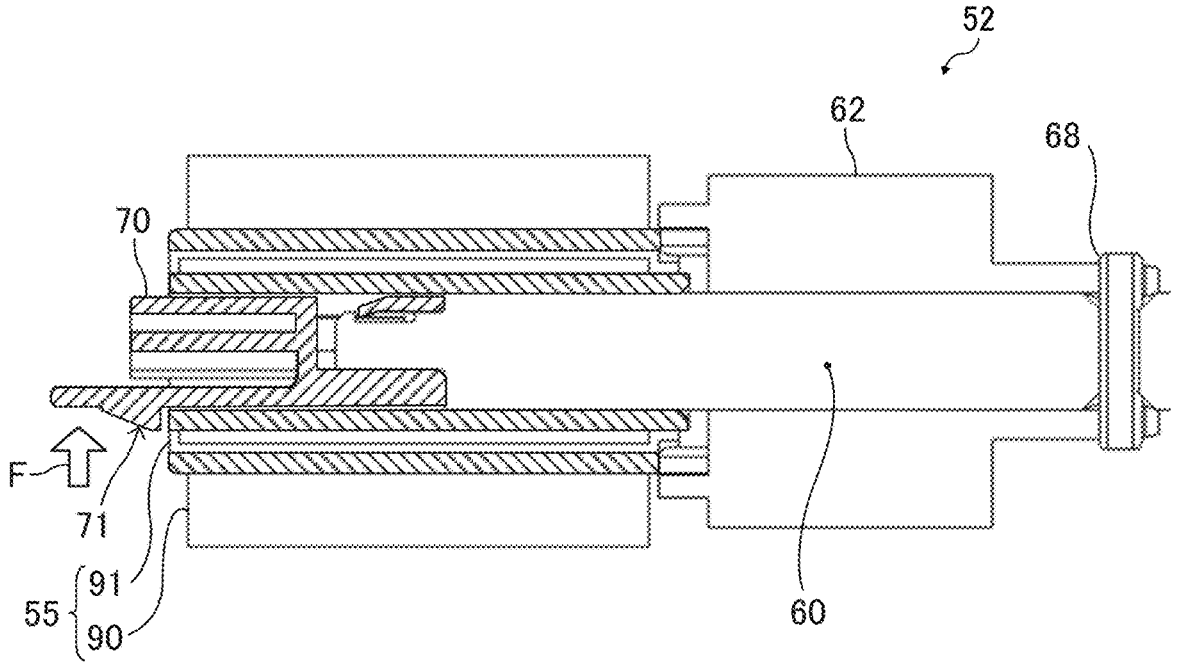

FIGS. 7A and 7B are longitudinal cross-sectional views illustrating the thrust regulation structure of the sheet feeding mechanism 52, along the center line of the roller attaching shaft 60. To be more specific, FIG. 7A is the longitudinal cross-sectional view illustrating the sheet feeding mechanism 52 of FIG. 6A, and FIG. 7B is the longitudinal cross-sectional view illustrating the sheet feeding mechanism 52 of FIG. 5A.

As illustrated in FIG. 7A, the roller attaching shaft 60 has an outer diameter D0 that is greater than an outer diameter D1 of the joint member 70. A small-diameter stepped surface 83 is provided between a portion having the outer diameter D0 of the roller attaching shaft 60 and a portion having the small-diameter joint portion 80 (including the D-cut portion 81). Additionally, a groove stepped surface 84 is generated on a tip of the groove 82 of the small-diameter joint portion 80. As illustrated in FIG. 7B, rear end face 77 of the joint member 70 abuts against the small-diameter stepped surface 83 to regulate the position of the joint member 70 on the right side of FIG. 7B with respect to the roller attaching shaft 60. Contact of a tip 78 of the joint claw 74 to the groove stepped surface 84 regulates the position of the joint member 70 on the left side of FIG. 7B. That is, a claw shape portion of the joint member is fitted and connected to the groove provided in the roller attaching shaft made of metal. The joint member 70 is fitted to the roller attaching shaft 60 by press fitting (light press fitting). In other words, a fitting method of the joint member 70 to the roller attaching shaft 60 employs a press fitting method (a light press fitting method).

Additionally, as illustrated in FIG. 7B, a shape corresponding to the D-cut portion 81 of the roller attaching shaft 60 is formed on an inner circumferential surface 79 of the joint member 70 at the insertion opening 72. The D-cut portion 81 is in contact with the inner circumferential surface 79, thereby causing the joint member 70 to rotate integrally with the roller attaching shaft 60. In other words, the roller attaching shaft made of metal and the joint member are regulated at the D-cut shape portion provided on the roller attaching shaft and joined in the rotational direction. Additionally, when force F is applied to the regulation claw 71 due to the hollow portion 75 and the cut portion 76, the regulation claw 71 is deformed using elasticity of resin. The sheet separation roller is elastically deformed when detaching or attaching the sheet separation roller to or from the image forming apparatus, thereby achieving execution or no execution of the thrust regulation. Specifically, the entire claw portion is elastically deformed so as to be shrunk in a radial direction of the roller attaching shaft, and thus the entire claw of the regulation claw 71 is fitted in a hole diameter of the end face of the sheet separation roller.

The sheet separation roller 55 is attached in a manner such that the inner circumferential surface of the sheet separation roller 55 contacts the outer circumference of the joint member 70. Specifically, in the example illustrated in FIG. 7B, a hub 91 that is a hole member is fitted in a center hole of a roller portion 90 made of rubber. The inner circumferential surface of the hub 91 contacts the outer circumferential surface of the joint member 70. The inner circumferential surface of the hub 91 functions as the inner circumferential surface of the sheet separation roller 55. The contact force between the inner circumferential surface of the hub 91 and the outer circumferential surface of the joint member 70 is contact force that causes the sheet separation roller 55 to be smoothly removed while regulation by the regulation claw 71 is released.

According to the above-described thrust regulation structure of the sheet feeding mechanism 52 of Embodiment 1, as illustrated in FIGS. 7A and 7B, the portion where the joint claw 74 of the joint member 70 is fitted and connected to the groove 82 provided at the roller attaching shaft 60 made of metal is located within the circumferential surface in the width range that is an axial length of the sheet separation roller 55. However, since the outer diameter D0 of the roller attaching shaft 60 is greater than the outer diameter D1 of the joint member 70, the outer circumferential surface of the joint member 70 is not in contact with the inner circumferential surface of the sheet separation roller 55, in other words, the outer circumferential surface of the joint member 70 contacts the inner circumferential surface of the sheet separation roller 55 in a partial width region, and therefore the inner circumferential surface of the sheet separation roller 55 is held by the roller attaching shaft 60 alone. Accordingly, the accuracy in the position of the sheet separation roller 55 with respect to the roller attaching shaft 60 is also easily obtained. Therefore, the roller portion 90 (made of rubber) of the sheet separation roller 55 is hardly unevenly worn away over time, and the outer diameter of the sheet separation roller 55 is hardly changed. As a result, a paper jam caused by the wear is prevented. Additionally, since the regulation claw 71 for the thrust regulation is provided in the joint member 70 that is fitted and connected to the roller attaching shaft 60, different from the configuration using a snap ring, the workability of the sheet feeding mechanism 52 is not degraded. Therefore, the operability at the time of attachment and detachment of the roller is greatly enhanced. Furthermore, since the regulation claw 71 achieves a further space-saving configuration than in the configuration employing the snap ring, the layout constraints of peripheral components are also reduced.

Additionally, the portion that executes the thrust regulation slides between the regulation claw 71 provided at the joint member 70 and a resin portion such as the hub 91 of the sheet separation roller 55. Therefore, the durability of the sheet feeding mechanism 52 against the wear is excellent. Accordingly, a highly durable device is provided.

Furthermore, since the sheet separation roller 55 is held at the roller attaching shaft 60 made of metal, a component such as a torque limiter, a one-way clutch, and a drive transmitter is also easily mounted.

Moreover, since a common product is employed without changing the shape of the sheet separation roller 55, a cost reduction and a backward compatibility are achieved by an increase in production quantity.

Additionally, a simple configuration such as the press fitting (the light press fitting) using elasticity of resin is employed as the joint device to joint the roller attaching shaft and the joint member. Therefore, replacement of components is easily performed, for example, in a case in which the joint member is damaged. Strength of joint in the axial direction is strength substantially maintaining engagement with the roller attaching shaft 60 against force toward the free end side in the axial direction. Here, the force is applied to the joint member 70 from the sheet separation roller 55 at the time of detaching the roller portion from the joint member 70 (removal to the tip of the joint member 70).

Furthermore, since regulation of the roller attaching shaft 60 and the joint member 70 in the rotational direction is performed based on a pin shaped portion (that is, a split pin or a parallel pin), wear caused by rotation of the roller attaching shaft 60 and the joint member 70 is prevented.

It is to be noted that the fitting method of fitting the roller attaching shaft 60 and the joint member 70 to each other and the regulating method of regulating the roller attaching shaft 60 and the joint member 70 in the rotational direction are not limited to the above-described methods. For example, the roller attaching shaft 60 and the joint member 70 may be fitted and regulated by adhesion. With this configuration, the roller attaching shaft and the joint member are fitted to each other with a simple configuration, and similarly, he roller attaching shaft and the joint member are regulated in the rotational direction with a simple configuration. Furthermore, the joint member is prevented from coming off and the wear caused by the rotation of the roller attaching shaft and the joint member is also prevented.

Furthermore, the roller attaching shaft and the joint member may be fitted by an outsert molding to the roller attaching shaft. Similarly, the roller attaching shaft and the joint member may be regulated in the rotational direction by the outsert molding to the roller attaching shaft. With this configuration, the roller attaching shaft and the joint member are fitted to each other and regulated in the rotational direction. Therefore, the relative position accuracy is enhanced, the joint member is prevented from coming off, and the wear caused by the rotation of the roller attaching shaft and the joint member is prevented.

Embodiment 2

Next, a description is given of a thrust regulation structure according to Embodiment 2 of this disclosure.

FIGS. 8A to 10B are explanatory views of a sheet feeding mechanism 52A according to Embodiment 2 of this disclosure, and correspond to the sheet feeding mechanism 52 according to Embodiment 1 in FIGS. 5A to 7B, respectively.

Figure 8A:
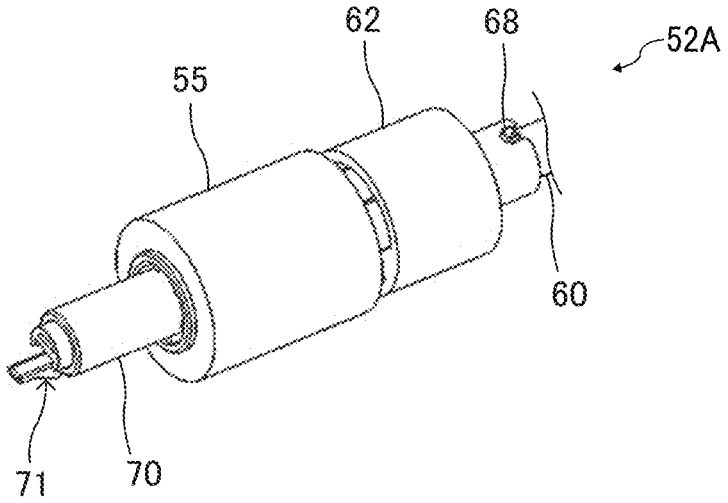
FIGS. 8A and 8B are diagrams illustrating a thrust regulation structure according to Embodiment 2.
Figure 8B:
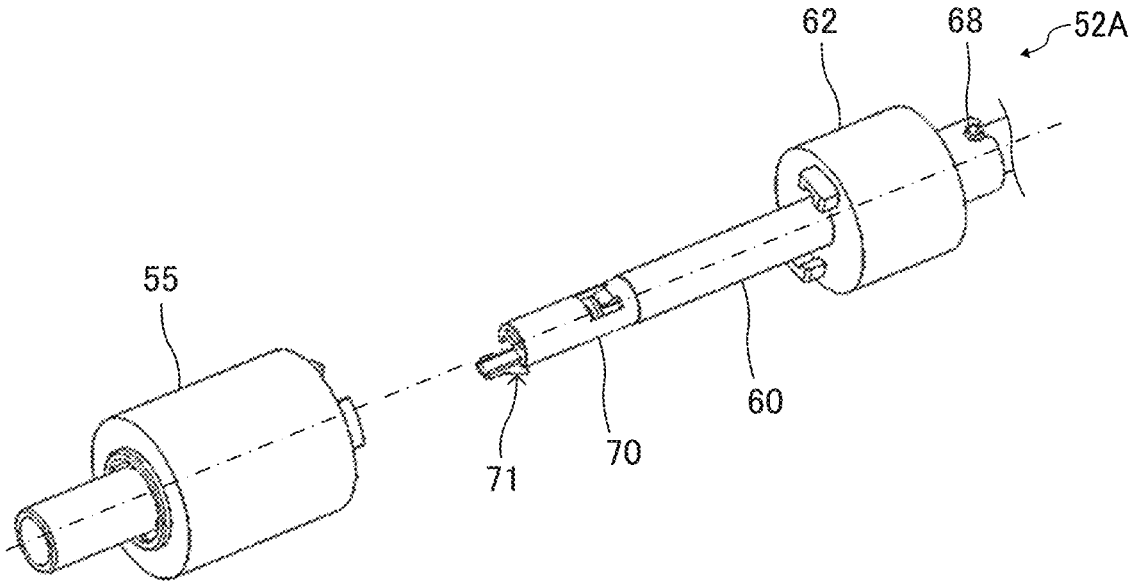

Specifically, FIGS. 8A and 8B are diagrams illustrating a thrust regulation structure of the sheet feeding mechanism 52A according to Embodiment 2, where the thrust regulation structure of the sheet feeding mechanism 52A is applied to the sheet separation roller 55 to prevent the sheet separation roller 55 from slipping from a free end of a shaft portion. To be more specific, FIG. 8A is an enlarged perspective view illustrating the thrust regulation structure of the sheet feeding mechanism 52A with the sheet separation roller 55 and parts disposed near the sheet separation roller 55, and FIG. 5B is an exploded perspective view of the thrust regulation structure of the sheet feeding mechanism 52A with the sheet separation roller 55 being removed.

Figure 9A:
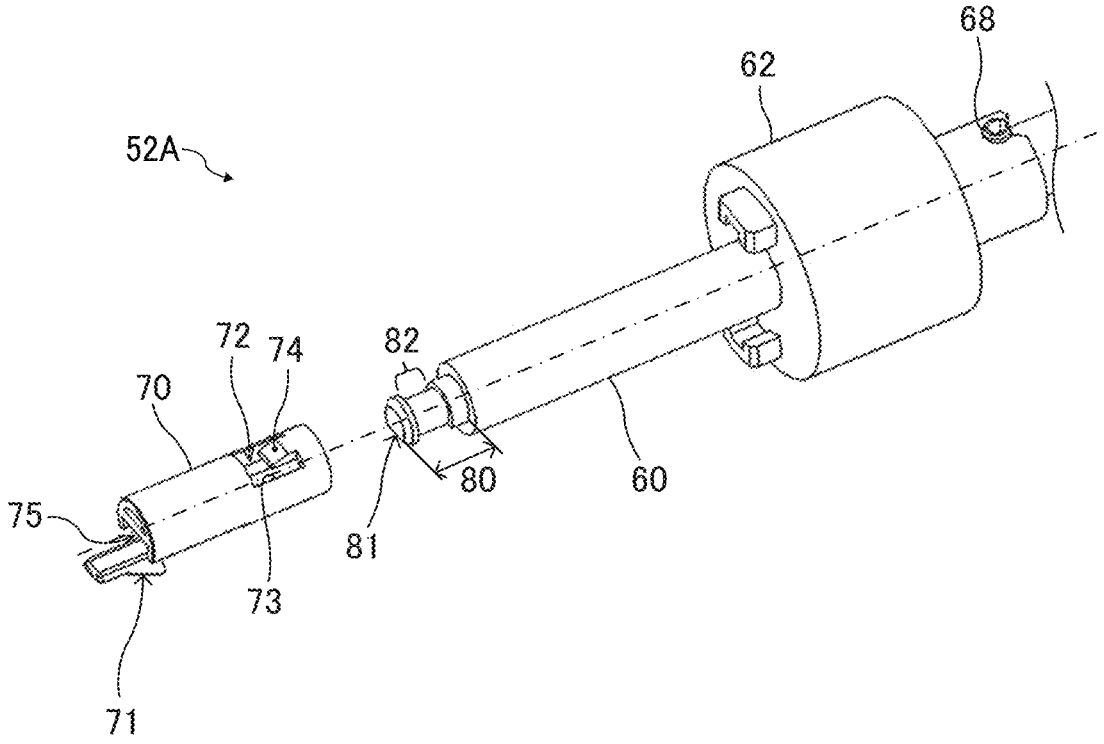
FIGS. 9A and 9B are diagrams illustrating a configuration of a joint portion of a joint member and an attaching shaft in the thrust regulation structure of FIGS. 8A and 8B.
Figure 9B:
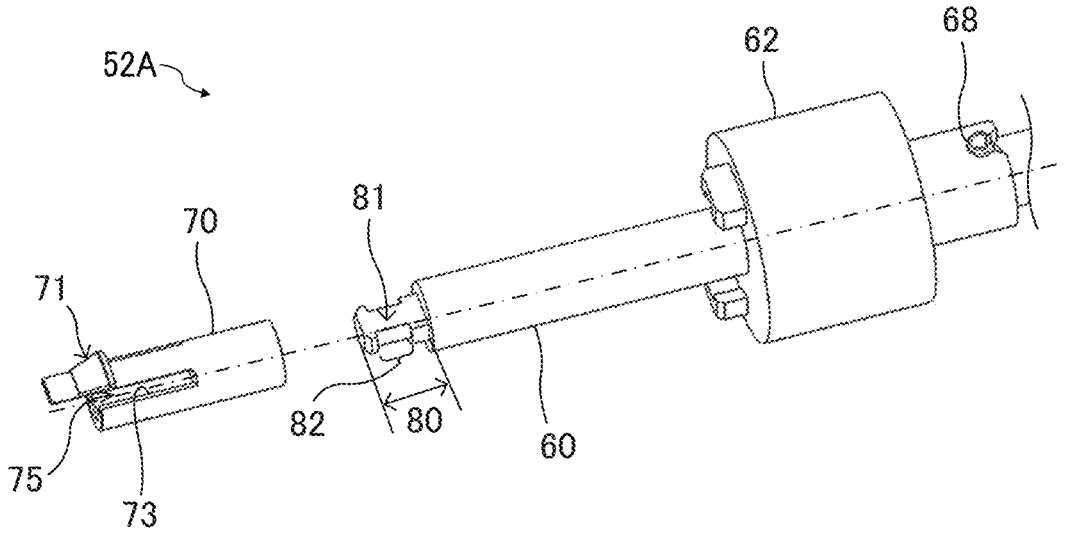

FIGS. 9A and 9B are diagrams illustrating a configuration of a joint portion of the joint member 70 and the roller attaching shaft 60 in the thrust regulation structure of the sheet feeding mechanism 52A of FIGS. 8A and 8B. Specifically, FIG. 9A is an exploded perspective view of the thrust regulation structure of the sheet feeding mechanism 52A in a state in which the joint member 70 is removed, and FIG. 6B is a perspective view of the thrust regulation structure of the sheet feeding mechanism 52A in a state in which the joint portion is rotated from the state of the sheet feeding mechanism 52 in FIG. 9A by 180 degrees around a center line of the joint member 70 and the roller attaching shaft 60.

Figure 10A:
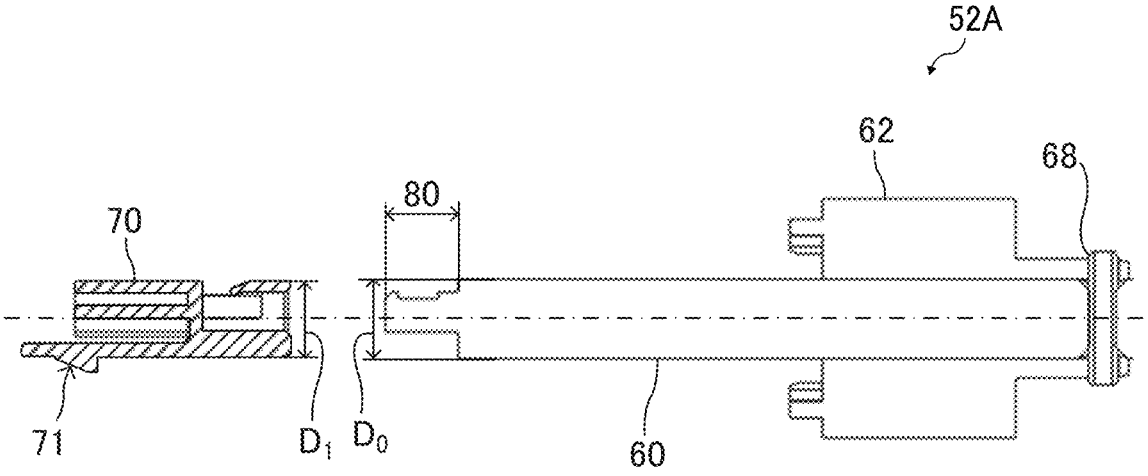
FIGS. 10A and 10B are longitudinal cross-sectional views illustrating the thrust regulation structure of the sheet feeding mechanism.
Figure 10B:
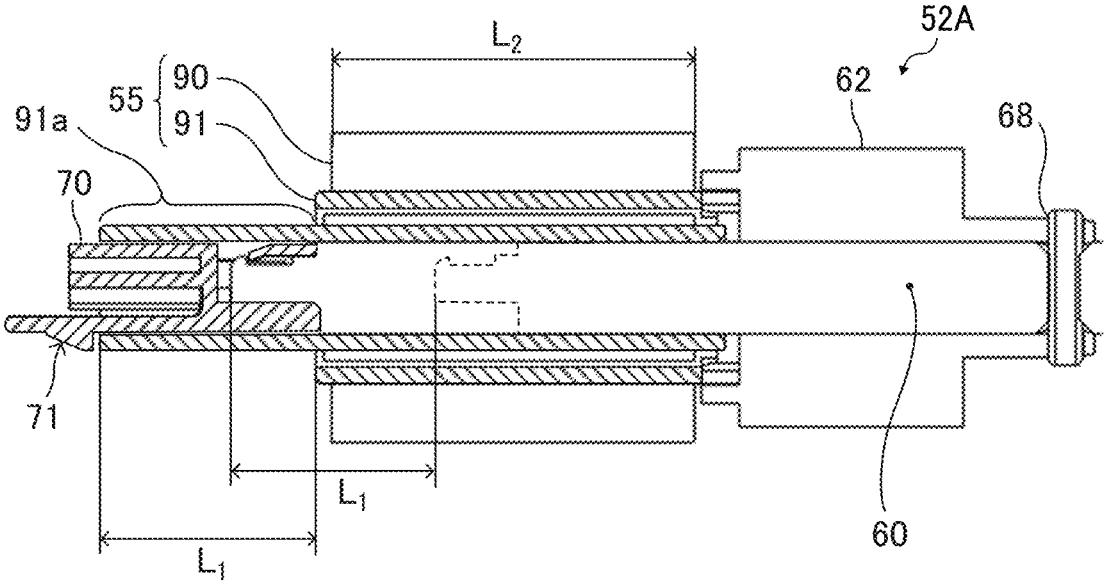

FIGS. 10A and 10B are longitudinal cross-sectional views illustrating the thrust regulation structure of the sheet feeding mechanism 52A, along the center line of the roller attaching shaft 60. To be more specific, FIG. 10A is the longitudinal cross-sectional view illustrating the sheet feeding mechanism 52A of FIG. 9A, and FIG. 10B is the longitudinal cross-sectional view illustrating the sheet feeding mechanism 52A of FIG. 8A.

In Embodiment 2, as the tip of the roller attaching shaft 60 of Embodiment 1 is illustrated by a virtual line (that is, a broken line) in FIG. 10B for comparison, a length of the tip of the roller attaching shaft 60 (in other words, a length to the tip from the torque limiter 62 that regulates the position of the sheet separation roller 55 on the right side in FIG. 10B) is longer than the length of the tip of the roller attaching shaft 60 in Embodiment 1 by a length indicated by L1 in FIG. 10B. The small-diameter joint portion 80 of the roller attaching shaft 60 is positioned more outwardly than the width of the roller portion 90 of the sheet separation roller 55 such that the outer circumference of the roller attaching shaft 60 contacts the inner circumferential surface of the hub 91 in an entire width region (an entire region in the width) L2 of the roller portion 90 of the sheet separation roller 55. Correspondingly, an inner cylindrical portion 91*a* of the hub 91 to be engaged with the regulation claw 71 of the joint member 70 is also extended to the front tip of the joint member 70 by the length L1. With this configuration, the entire inner circumferential surface corresponding to the width of the roller portion 90 of the sheet separation roller 55 is supported by a large-diameter shaft portion of the roller attaching shaft 60. Additionally, the regulation claw 71 is engaged with the end face of the tip of the hub 91 of the sheet separation roller 55 extending by the length L1. Thus, the sheet separation roller 55 is regulated in the thrust direction of the sheet separation roller 55 along the roller attaching shaft 60 by the thrust regulation of the sheet feeding mechanism 52A. The roller attaching shaft 60 made of metal according to Embodiment 2 is longer than the roller attaching shaft 60 according to Embodiment 1 and the inner circumferential surface of the sheet separation roller 55 is held by the roller attaching shaft 60. Therefore, the positional accuracy of the sheet separation roller 55 is easily obtained, the rubber portion of the sheet separation roller is hardly worn away over time, and the outer diameter of the sheet separation roller is hardly changed. Consequently, paper jam caused by the wear is prevented.

As described above, the respective embodiments, Embodiments 1 and 2, relate to the sheet separation roller 55. However, the similar thrust regulation structure is also applicable to rollers such as the sheet feed roller 53, the pickup roller 54, and the sheet conveying roller 59. In this case, in a case in which a roller that does not require rotation regulation relative to the roller attaching shaft, the configuration to regulate rotation between the roller and the joint member or between the joint member and the roller attaching shaft.

Additionally, since the roller attaching shaft in Embodiments 1 and 2 includes metal material, the roller attaching shaft has sufficient strength, and smoothness of the outer circumferential surface of the roller attaching shaft is obtained. Instead of the roller attaching shaft made of metal, a roller attaching shaft including a resin material may be employed. In this case, in a case in which the joint member and the hub also include the resin, contact portions between the roller attaching shaft and each of the joint member and the hub are made of resin material. Therefore, the wear caused by scraping is more reduced than the contact between the metal (in other words, the roller attaching shaft made of metal) and the resin (in other words, the joint member made of resin material or the hub made of resin material). Also, in this case, the softer resin is generally deformed more easily. Therefore, it is preferable that the joint member includes a soft resin and the roller attaching shaft includes a hard resin.

Additionally, the configurations of Embodiments 1 and 2 are the examples in which the thrust regulation structure is applied to the sheet feeding device. However, the thrust regulation structure is also applicable to an image forming apparatus or another sheet handling device provided in another apparatus.

It is to be noted that, in the above description, the term "image forming apparatus" means an apparatus that performs image formation by making developer and ink adhere to a sheet that is a recording medium to record an image. Further, it is to be noted that the term "image formation" indicates an action for providing (i.e., printing) not only an image having meanings such as texts and figures on a recording medium but also an image having no meaning such as patterns on a recording medium. Additionally, the term "sheet" is not limited to paper (paper sheet) and includes an overhead projector (OHP) sheet, cloth, and the like, and means a medium or a document to which a developer or ink can be made to adhere.

In addition, the term "sheet" is not limited to a flexible sheet such as a plain paper but also is applicable to a rigid plate-shaped sheet and a relatively thick sheet such as thick paper, post card, envelope, thin paper, coated paper, art paper, and tracing paper. In the above-described embodiment, a sheet is described as the "paper sheet", and the dimensions, the materials, the shapes, the relative arrangements, and the like described for the respective component are examples, and the scope of the present invention is not intended to be limited thereto unless otherwise particularly specified. Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. Additionally, the dimensions, the materials, shapes, the relative arrangements, and the like described for the respective component are merely examples, and the scope of the present invention is not intended to be limited thereto unless otherwise particularly specified.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

What is claimed is:

1. A sheet handling device comprising:

a shaft;

a roller detachably attached on an end portion of the shaft; and a joint including a claw at a tip of the joint at a first end of the joint and an opening at a second end of the joint, the second end being opposite from the first end, and the shaft being configured to be insertably connected to the joint via the opening, the claw of the joint being configured to position the roller in a thrust direction along the shaft while an inner circumferential surface of the roller is in contact with an outer circumferential surface of the shaft, the inner circumferential surface of the roller having a cylindrical shape, wherein a first diameter of an outer circumferential surface of the joint is smaller than a second diameter of the outer circumferential surface of the shaft.

2. The sheet handling device according to claim 1, wherein the outer circumferential surface of the shaft is configured to contact a partial width region in the thrust direction on the inner circumferential surface of the roller.

3. The sheet handling device according to claim 1, wherein the outer circumferential surface of the shaft is configured to contact an entire width region in the thrust direction on the inner circumferential surface of the roller.

4. The sheet handling device according to claim 1, wherein the shaft and the joint are fitted by press fitting.

5. The sheet handling device according to claim 1, wherein the shaft and the joint are fitted using elasticity of resin.

6. The sheet handling device according to claim 1, wherein the shaft and the joint are regulated in a rotational direction of the shaft and a rotational direction of the joint.

7. The sheet handling device according to claim 6, wherein the shaft and the joint are regulated at a D-cut shape portion.

8. The sheet handling device according to claim 6, wherein the shaft and the joint are regulated at a pin shaped portion.

9. The sheet handling device according to claim 6, wherein the joint is connected and regulated to the shaft by adhesion.

10. An image forming apparatus comprising the sheet handling device according to claim 1.

11. The sheet handling device according to claim 1, wherein the tip of the joint defines a hollow portion.

12. The sheet handling device according to claim 1, wherein the shaft includes a small-diameter joint portion, and a third diameter of an outer circumferential surface of the small-diameter joint portion is smaller than the second diameter of the outer circumferential surface of the shaft.

13. The sheet handling device according to claim 12, wherein the shaft further includes a small-diameter stepped surface between a portion of the shaft having the second diameter and the small-diameter joint portion.

14. The sheet handling device according to claim 1, wherein the shaft comprises a metal material.

15. The sheet handling device according to claim 1, wherein the joint comprises a resin material.

16. The sheet handling device according to claim 1, wherein the roller comprises a rubber material.

* * * * *